United States Patent [19]

Achelpohl

[11] 4,440,386

[45] Apr. 3, 1984

[54] APPARATUS FOR FORMING STACKS READY TO BE PACKAGED FROM FLAT WORKPIECES

[75] Inventor: Fritz Achelpohl, Lengerich, Fed. Rep. of Germany

[73] Assignee: Windmoller & Holscher, Lengerich, Fed. Rep. of Germany

[21] Appl. No.: 354,534

[22] Filed: Mar. 4, 1982

[30] Foreign Application Priority Data

Mar. 4, 1981 [DE] Fed. Rep. of Germany ..... 3108195

[51] Int. Cl.[3] ..... B65H 29/68

[52] U.S. Cl. ..... 271/70; 271/186; 271/217; 493/448

[58] Field of Search ..... 271/70, 72, 186, 190, 271/217, 218, 215, 66; 493/448

[56] References Cited

U.S. PATENT DOCUMENTS 3,389,906 6/1968 Walton ..... 271/70

3,759,402 9/1973 Hitch ..... 271/217 X

FOREIGN PATENT DOCUMENTS 2356877 5/1975 Fed. Rep. of Germany .

*Primary Examiner*—Richard A. Schacher

*Attorney, Agent, or Firm*—Fleit, Jacobson, Cohn & Price

[57] ABSTRACT

In a stacking apparatus for flexible sheets comprising a chain conveyor consisting of two spaced chains running over sprockets at the delivery end, each sheet is supported on a depositing plate which is provided with fingers and of which the leading end is connected to the chains so that the plate is swung through 180° at the delivery end of the chain conveyor and the sheet is placed onto a stack which, when finished, is discharged on spaced belts of a discharge conveyor under the chain conveyor. Each sheet is received in a stacking shaft defined by side walls, a vertically slotted rear wall and a base formed by prongs passing through the slots. The prongs are lowered as the stack height increases until they have passed between the belts of the discharge conveyor, whereupon they are withdrawn. End portions of each sheet projecting beyond the side walls of the shaft are turned inwardly over the fingers of the depositing plate by reciprocatable folding blades.

2 Claims, 2 Drawing Figures

10
7
6
II
II
12
18
19
5
4
2'
2
4
3
5
2''
1
11
13
14

19
16
9
8
15
18
4
17

APPARATUS FOR FORMING STACKS READY TO BE PACKAGED FROM FLAT WORKPIECES

The invention relates to an apparatus for forming stacks ready to be packaged from flat workpieces such as flattened bags or sacks, comprising a depositing conveyor which is continuously and successively supplied with the workpieces by a conveyor and which consists of two parallel endless chains, the chains running over two spaced sprockets with parallel rotary axes and being hinged by two spaced pins to the front end of a depositing plate provided with rake-like fingers, and comprising a conveyor belt which intermittently discharges the formed stacks and is disposed below the throw-off station formed by the depositing plate, the latter swinging through 180° when passing over the head end of the depositing conveyor.

In a known apparatus of this kind known from practice, the discharge conveyor is constructed to be lowerable as the stack height increases. However, it is difficult to achieve edge-aligned stacks because the individual workpieces are slapped onto the growing stack by the depositing plate and can subsequently slip when the depositing plate is withdrawn.

It is therefore the problem of the invention to provide an apparatus of the aforementioned kind with which flat workpieces can be superposed to form handy edge-aligned stacks which can be packaged in a simple manner such as for purpose of dispatch.

According to the invention, this problem is solved in an apparatus of the aforementioned kind is that the conveying plane of the discharge conveyor belt, which consists of a plurality of spaced individual belts, lies below the depositing conveyor at a distance equal to the height of the stacks to be formed, that a stacking shaft disposed beneath the depositing plate which has just swung through 180° is defined by side walls and by a rear wall provided with vertical slots, the base of the shaft being formed by fork-like prongs which are lowerable as the stack height increases, are reciprocatable in the conveying plane of the discharge conveyor, engage through slots in the rear wall and are lowerable between the individual belts in grooves of the direction-changing drum to below the conveying plane of the discharge conveyor, and that overlapping folding blades are provided which are successively horizontally movable into and out of the stacking shaft transversely over the upper edges of the side walls and the lateral prongs of the depositing plate which has been swung into the shaft. The apparatus of the invention permits not only edge-aligned stacks to be formed in the stacking shaft but, to produce handy stacks, the area of the bags or the like is reduced by turning inwardly their side portions which were erected along the side walls of the stacking shaft by the swung-over depositing plate. Since the side portions of the work pieces are folded inwardly about the lateral prongs of the depositing plate by means of the folding blades, the spacing of the outer prongs determines the width of the stack. The prongs are therefore so adapted to the internal spacing of the side walls of the stacking shaft that they support the growing stack and prevent lateral slipping. The apparatus of the invention permits the workpieces to be deposited continuously because the folding blades are inserted on commencement of the return motion of the fork-shaped depositing plate, i.e. at an instant when the side portions can still be accurately folded about the outer prongs of the depositing plate.

From DE-OS No. 23 56 877, it is known to push flat stacks into a shaft by means of a slide member and to turn the side portions of the stack erected at the side walls of the shaft inwardly to overlap each other by means of laterally introducible folding blades.

One advantageous embodiment of the invention has been described in the subsidiary claim.

An example of the invention will now be described in more detail with reference to the drawing, wherein.

Figure 1:
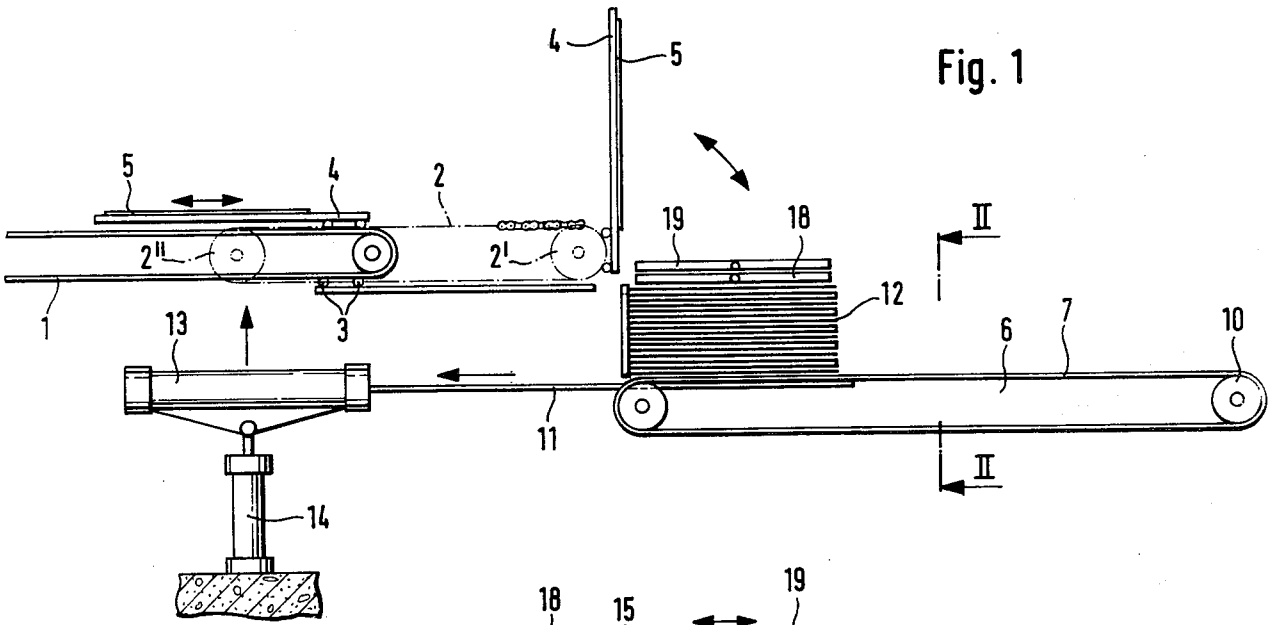
FIG. 1 is a diagrammatic side elevation of the stacking apparatus.

The stacking apparatus shown in the drawing consists of a conveyor belt 1 with spaced circulating belts for successively and continuously supplying the workpieces 5 to be stacked. The supply conveyor belt 1 is followed by the depositing conveyor 2 which consists of three parallel chains carrying pins 3 which co-operate in pairs. The leading ends of depositing plates 4 are hinged to each pair of pins, of which the pins are arranged behind each other at a small spacing in the conveying direction. The depositing plates 4 consist of three prongs or supporting fingers which are juxtaposed in the manner of a rake and which are each secured to the synchronously moving chains by means of the pins 3. The supply conveyor belt 1 and the depositing conveyor 2 interengage in the manner of teeth as shown in FIG. 1 so that they define an overlapping conveying zone.

The spacing between the pins 3 is sufficiently large to permit them to mount the depositing plates 4 with an adequate lever arm and to facilitate an unimpeded passage of the depositing plates 4 over the sprockets 2' and 2''.

The prong-like depositing plates 4 have a width permitting them to pass without obstruction through the conveyor belt 1 in the gaps formed between the individual belts.

Since the conveyor belt 1 and the depositing conveyor 2 interengage, the depositing plates 4 lift from the conveyor belt 1 the workpieces 5 supplied by the conveyor belt 1, turn each through 180° and place it on the rake 11 forming the base of the stacking shaft. The supply of the individual workpieces 5 is so tuned to the passage of the depositing plates 4 that each of the latter have one workpiece transferred to it from the conveyor belt 1.

The depositing conveyor 2 is followed by a further conveyor belt 6 which is disposed under the underside of the depositing conveyor 2 by a distance equal to the largest stack height to be formed.

The conveyor belt 6 likewise comprises a plurality of spaced juxtaposed individual belts 7 carried by shafts 9 and 10 of which at least the shaft 9 has a plurality of juxtaposed annular recesses 8. In the position shown in FIGS. 1 and 2, a rake 11 has been placed in the recesses 8 of the shaft 9 so that the finished stack 12 can be taken away by the conveyor belt 6. Thereafter, the rake 11 is withdrawn from the recesses 8 by a piston-cylinder unit 13 and moved upwardly by the piston-cylinder unit 14. Subsequently, the rake 11 is introduced by the piston-cylinder unit 13 through slot-shaped interruptions in the rear wall 15 of a cassette which is formed by the rear wall 15 and side walls 16 and 17. The rake 11 is lowered as the stack height increases.

Figure 2:
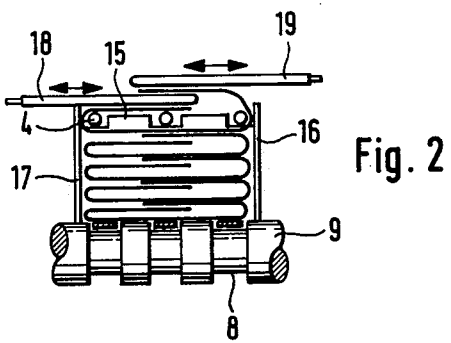
FIG. 2 is a section on the line II—II of FIG. 1.

However, since the spacing of the side walls 16 and 17 is less than the width of the individual workpieces to be deposited in the cassette, the workpiece portions that project beyond the side walls 16 and 17 stand upright after they have been pressed into the cassette by the weight fingers of the plate 4. At this instant, folding blades 18 and 19 are laterally introduced from both sides so that the vertically upwardly projecting portions of each workpiece are folded inwardly as shown in FIG. 2. In this way it is possible to achieve proper depositing of, for example, carrier bags.

I claim:

1. Apparatus for forming stacks ready to be packaged from flat workpieces such as flattened bags or sacks, comprising a depositing conveyor which is continuously and successively supplied with the workpieces by a conveyor and which consists of two parallel endless chains, the chains running over two spaced sprockets with parallel rotary axes and being hinged by two spaced pins to the front end of a depositing plate provided with rake-like fingers, and a conveyor belt which intermittently discharges the formed stacks and is disposed below the throw-off station formed by the depositing plate, the latter swinging through 180° when passing over the head end of the depositing conveyor, characterised in that the conveying plane of the discharge conveyor belt, which consists of a plurality of spaced individual belts, lies below the depositing conveyor at a distance equal to the height of the stacks to be formed, that a stacking shaft disposed beneath the depositing plate which has just swung through 180° is defined by side walls and by a rear wall provided with vertical slots, the base of the shaft being formed by fork-like prongs which are lowerable as the stack height increases, are reciprocatable in the conveying plane of the discharge conveyor, engage through slots in the rear wall and are lowerable between the individual belts in grooves of the direction-changing drum to below the conveying plane of the discharge conveyor, and that overlapping folding blades are provided which are successively horizontally movable into and out of the stacking shaft transversely over the upper edges of the side walls and the lateral prongs of the depositing plate which has been swung into the shaft.

2. Apparatus according to claim 1, characterised in that the prongs defining the shaft base are secured to the piston rod of a piston-cylinder unit of which the cylinder is secured to the piston rod for a vertical piston-cylinder unit.

* * * * *